United States Patent [19]

Cowan

[11] 4,105,119

[45] Aug. 8, 1978

[54] DART GAME HOLDER AND SCORE KEEPER

[76] Inventor: Arlis L. Cowan, 723 Marshall Ave., Medford, Oreg. 97501

[21] Appl. No.: 824,242

[22] Filed: Aug. 12, 1977

[51] Int. Cl.[2] ..... B65D 69/00

[52] U.S. Cl. ..... 206/579; 206/459; 211/60 R; 273/95 R; 273/102.1 E; 273/DIG. 26

[58] Field of Search ..... 273/95 R, 102 R, 102 S, 273/102 B, 102.1 R, 102.1 E, 102.1 F, 105.2, 105.6, 106.5 R, 106.5 A, 106.5 B, 106.5 C, 106.5 D, DIG. 26; 211/60 R; 206/315 R, 579, 459

[56] References Cited

U.S. PATENT DOCUMENTS

| | | | |
|---|---|---|---|
| 2,087,445 | 7/1937 | Price | 273/106.5 R |
| 2,179,471 | 11/1939 | Lee | 273/105.2 |
| 2,264,492 | 12/1941 | Weaver | 273/DIG. 26 |
| 3,036,705 | 5/1962 | Haecker | 206/579 |
| 3,088,583 | 5/1963 | Holtz | 206/315 |
| 3,151,741 | 10/1964 | Haecker | 206/579 |
| 3,415,519 | 12/1968 | Hand | 273/102 S |
| 3,784,201 | 1/1974 | Wyman | 273/102.1 E |

*Primary Examiner*—William H. Grieb
*Attorney, Agent, or Firm*—Clarence M. Crews

[57] ABSTRACT

This invention relates to a competitive dart throwing game and is directed to means for conveniently keeping the game components together when idle and for keeping the scores when the game is being played.

3 Claims, 5 Drawing Figures

DART GAME HOLDER AND SCORE KEEPER

It is the object of the present invention to provide a holding and scoring device for a dart game in the form of a frame, preferably of hollow rectangular form.

The frame desirably includes, upon parallel supports, a bottom horizontal cross member having vertical dart receiving openings, suitable in number exactly to accommodate all the dart forming components of the game equipment.

The frame also includes two suitably spaced upright members between which two goal rings may be removably received, each upright member including two laterally spaced nails or like projections between which two goal hoops or rings of appropriate diameter may be fitted for carrying and storage in upright attitudes.

A horizontal handle member rigidly connects the upper ends of the upright frame members. At the upper end of each upright member a circular disc is rotatively mounted, the discs, like the darts, being differentiated as to color so that each corresponds in color to one of the two sets of darts and is made to serve as a score indicator for the player or team assigned the darts of corresponding color.

In the drawing forming part of this specification,

Figure 1:
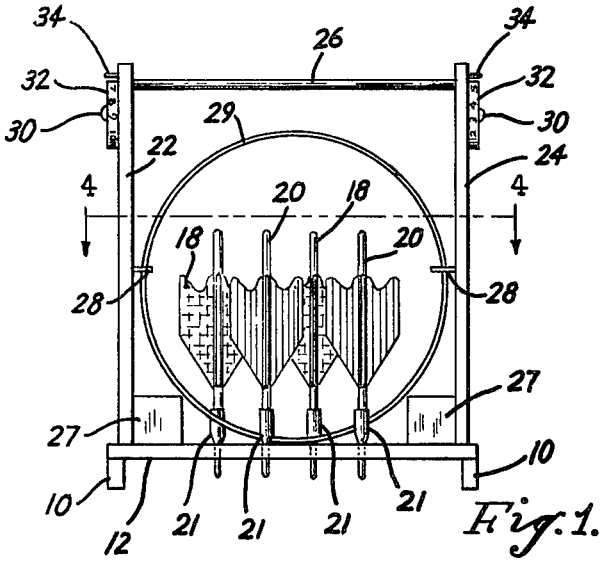
FIG. 1 is a full front view of a packing and scoring frame with the darts and target rings packed in it.
Figure 2:
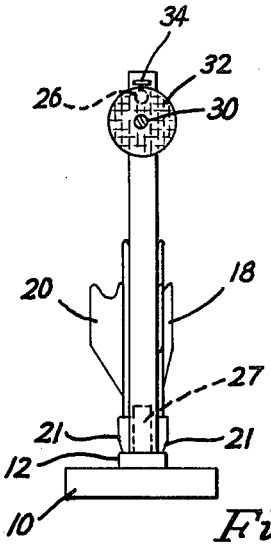
FIG. 2 is a view in side elevation of the equipment shown in FIG. 1.
Figure 3:
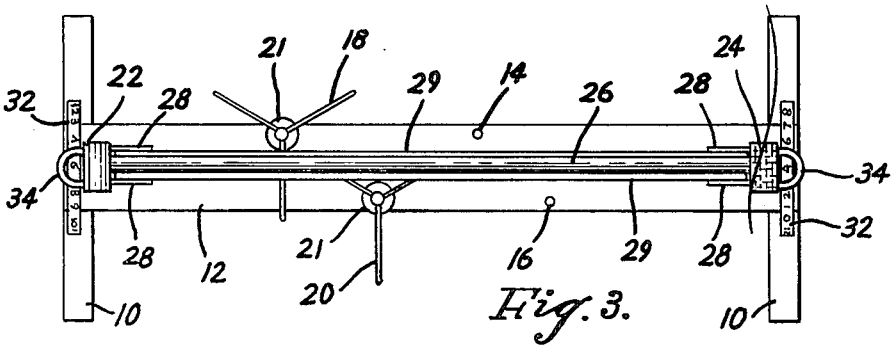
FIG. 3 is a plan view on a larger scale than FIGS. 1 and 2 of the equipment shown in FIGS. 1 and 2, but with two of the darts removed.
Figure 4:
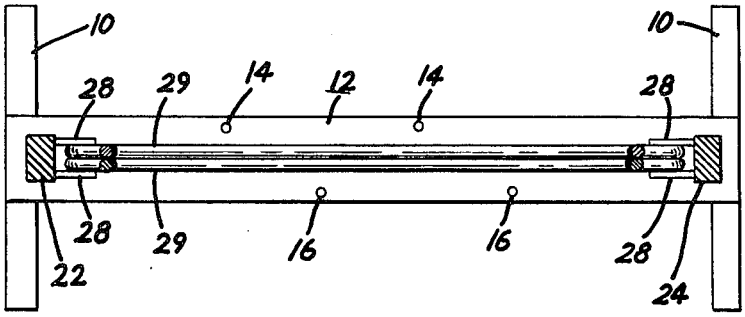
FIG. 4 is a view similar to FIG. 3 but with the top frame bar omitted for the purpose of showing clearly how the goal rings are packed for storage.
Figure 5:
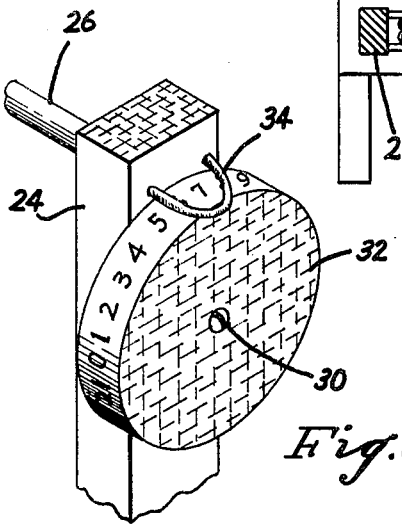
FIG. 5 is a fragmentary perspective view of one of the scoring discs and associated indicating means, showing how a score is to be read.

The framework of the storing and score indicating device comprises two fore-and-aft extending base members 10,10. Upon the base members 10,10 a crossbar 12 is made fast, the crossbar 12 having a plurality, illustratively a pair, of spaced vertical holes 14,14 through one of its margins and a plurality illustratively a pair, of spaced vertical holes 16,16 through its opposite margin.

Yellow darts 18,18 have their tips lodged in the holes 14,14 and red darts 20,20 have their tips lodged in the holes 16,16. It is actually immaterial, of course, which colored darts are stored in which holes.

Each dart has fixed upon it a metallic collar 21 which gives a desired balance to the dart, and also limits the length of dart tip that projects through and beneath the member 12, the arrangement desirably being such that no dart tip touches the ground.

Two vertical posts 22,24 of equal heights extend upward from opposite ends of the crossbar 12 and have their upper ends rigidly joined to one another through a handle rod 26. The posts 22 and 24 are rigidly connected to the crossbar 12 through rectangular corner blocks 27. Each of these posts has affixed to it at a suitable level a pair of spaced nails 28,28, between which two rings 29,29 may be inserted, each ring having a diameter equal substantially to the space between the posts, and the nails being spaced above the bar 12 by a distance equal to the external radius of a ring.

The upper ends of the posts 22,24 are colored yellow and red, respectively. Rotatively mounted on each post by means of a screw 30, near the upper end thereof, is a scoring wheel 32 whose periphery is graduated with equal, consecutively numbered divisions. The tops of the posts are colored yellow and red, respectively, and each scoring disc has a lateral face colored the same as the top of the post with which it is associated.

Each disc is surmounted by a staple 34 through which a single member on the periphery of the associated disc may be seen and read.

The game is usually played on a partnership basis with one side using the yellow darts and the other using the red darts. The combined storing and scoring device may be kept at the end with the team captains.

It will be understood, of course, that the colors red and yellow have been arbitrarily chosen for illustrative purposes and that any two distinctive colors may be utilized for the respective opposing sides.

It has been mentioned that the nails 28,28 serve to confine the target rings 29,29 in a stored condition. The stored darts contribute to the same end.

I have described what I believe to be the best embodiment of my invention. What I desire to cover by letters patent, however, is set forth in the appended claims.

I claim:

1. An upstanding storing and score keeping frame for target rings and for pointed tip darts of distinctive colors adapted to be thrown at the target rings when the rings are placed upon the ground, said frame including (a) a normally horizontal lower crossbar having perforations in which the tips of vertically disposed darts are adapted to fit, (b) upstanding legs at opposite ends of the crossbar;

(c) manually settable score indicating devices on the respective legs, (d) fixed score identifying reference members affixed to the respective legs in association with the respective score indicating devices, and (e) fixed fore-and-aft spaced, inwardly directed members carried by the respective legs between which the rings may be confined for storage, the dart receiving perforations in the crossbar being so spaced that the darts, themselves, will contribute to the confining of the rings in stored positions.

2. A game storing and score keeping frame for rings and darts as set forth in claim 1 in which the crossbar perforations are too small to pass downward anything more than short tip portions of the ring confining darts and the frame includes fixed fore-and-aft extending, supporting members beneath said crossbar of greater height than said tip portions of the darts.

3. A game storing and score keeping frame as set forth in claim 1 in which the upper ends of the upstanding legs of the frame are connected to one another and reinforced by a crosswise extending carrying rod.

* * * * *